US006009874A

United States Patent [19]

Sartin et al.

[11] Patent Number: 6,009,874

[45] Date of Patent: Jan. 4, 2000

[54] DIAPER CHANGING RESTRAINT SYSTEM

[76] Inventors: James P. Sartin; Kelly Sartin, both of 510 Old Chartwell Crossing, Alpharetta, Ga. 30022

[21] Appl. No.: 09/133,476

[22] Filed: Aug. 13, 1998

[51] Int. Cl.[7] ..... A61B 19/00

[52] U.S. Cl. ..... 128/869; 128/874; 128/875

[58] Field of Search ..... 128/869, 870, 128/871, 872, 873, 874, 875, 876

[56] References Cited

U.S. PATENT DOCUMENTS

| | | | |
|---|---|---|---|
| 1,696,559 | 12/1928 | Ward | 128/875 |
| 2,342,069 | 2/1944 | Wilkinson | 128/874 |
| 2,547,466 | 4/1951 | Hoder | 128/875 |
| 2,758,595 | 8/1956 | Lovett | 128/875 |
| 2,846,700 | 8/1958 | De Puy | 5/317 |
| 3,323,150 | 6/1967 | Rehder | 128/875 |
| 4,205,669 | 6/1980 | Hamann . | |
| 4,216,951 | 8/1980 | Griffin . | |

*Primary Examiner*—Michael A. Brown
*Assistant Examiner*—Linda Park
*Attorney, Agent, or Firm*—Deveau & Marquis; Todd Deveau

[57] ABSTRACT

A diaper changing restraint system for restraining an infant while changing the infant's diaper. The system provides a four-point restraint system for securing the infant by itself or in conjunction with a diaper-changing table. The system includes a bottom portion, a top portion and a mechanism for fastening the top portion to the bottom portion. The top portion is generally one piece and is in the shape of the front of a tank-top shirt having two shoulder straps and two side portions. The bottom portion includes a stiff stable surface having four cloth-like material portions attached thereto. The four cloth-like material portions are positioned so as to align with the two shoulder straps and the two side portions of the top portion. A fastening mechanism, preferably hook and pile (i.e., VELCRO®), is provided for attaching the top portion to the bottom portion via the two shoulder straps and the two side portions.

In use, the stiff stable surface of the bottom portion is positioned under the pad of a typical diaper-changing table with the four cloth-like portions extending therefrom. The infant is placed on the pad, and the top portion is then placed over the infant. The two shoulder straps and the two side portions of the top are fastened to the four cloth-like portions of the bottom to comfortably and safely secure the infant on the changing table.

10 Claims, 1 Drawing Sheet

DIAPER CHANGING RESTRAINT SYSTEM

TECHNICAL FIELD

The present invention relates generally to infant restraint systems and, more specifically, to a diaper changing restraint system for use by itself or in conjunction with a diaper changing table to safely and comfortably secure an infant while performing a diaper change.

BACKGROUND ART

For many parents and babysitters, changing an infant's diaper can sometimes prove to be a difficult task. As is indicative of many infants, an infant, typically, will not remain still during a diaper change. If capable, he or she will struggle to sit up or roll over, possibly due to a suddenly new found interest in a toy or other object, thereby making the task of diaper changing a multiple-hand challenge. For instance, one hand is needed to hold the infant in a secure position while one or more hands are needed to remove and replace the diaper. Because most individuals do not have the dexterity to perform such as task, the infant is often not safely secured on a changing table or the like. As a result, the individual changing the diaper must maintain constant supervision and attention to the infant. Injuries to the infant can occur when, during the diaper changing process, the individual is briefly interrupted by a phone call, doorbell, another child or some other distraction, thereby causing the individual to leave the infant unattended. Because most diaper changing tables are raised several feet off the ground, an unattended infant can, in a short period of time, tumble off the table resulting in severe injuries to the infant.

In an attempt to overcome some of these problems and deficiencies, straps and other mid-body restraints have been disclosed wherein the infant is partially held into position on the changing table. Examples of such devices may be found by reference to DePuy (U.S. Pat. No. 2,846,700), Hamann (U.S. Pat. No. 4,205,669) and Griffin (U.S. Pat. No. 4,216,951). The DePuy patent discloses an infant dressing table having a pad and a restraining strap extending therethough for strapping around an infant's mid-body. This device is disadvantageous in that it fails to adequately secure the infant. For instance, the infant's hands are free to manipulate the single strap and thus possibly maneuver out of the device. In addition, depending on what portion of the infant's mid-body the strap is placed on, the infant, if capable, can sit up and/or move its lower body, thereby making it more difficult for the diaper changer. The Griffin patent, similar to the DePuy patent, discloses a changing table having a pad and a mid-body belt. Additionally, the Griffin patent incorporates a roll of paper extending over the surface of the table for use as a sanitary surface. As in DePuy, Griffin does not adequately secure the infant on the table. The Hamann patent discloses a diaper-changing aid having an arcuate soft yieldable material that extends across the infant's chest. Additional straps are provided at the lower portion for securing the infant's feet. Although the Hamann patent better secures the infant on the table as compared to DePuy and Griffin, Hamann too has many disadvantages. For instance, the Hamann device is bulky and thus not easily transportable. In addition, because it is typically necessary to lift the infant's feet and legs during the changing process, feet restraints are disfavored. Similar to the Griffin and DePuy patents, with the Hamann design an infant is still capable of manipulating the restraining device thereby, possibly escaping and falling off the table. It is readily apparent that an improved infant restraint system for use on or in conjunction with diaper changing tables having means for adequately and comfortably restraining an infant during a diaper change is needed. It is, therefore, to the provision of such an improvement that the present invention is directed.

BRIEF SUMMARY OF THE INVENTION

Briefly described, in a preferred embodiment, the present invention overcomes the above-mentioned disadvantages by providing a device having a four-point restraint system for adequately securing an infant on a diaper changing table. More specifically, in a preferred embodiment, the restraint is in the shape of a tank-top shirt and is made of cotton or other similar material, and therefore, the present invention is comfortable and natural feeling to an infant.

The present invention, preferably, comprises a bottom portion and a top portion. The top portion is, generally, in the shape of a tank-top shirt having two shoulder straps and two side portions. The top portion is, preferably, one piece and is defined, generally, as the front portion of a typical tank-top shirt.

The bottom portion comprises a stiff stable surface having four cloth-like material portions attached thereto. The four cloth-like material portions are positioned so as to align with the two shoulder straps and the two side portions of the top portion. A fastening means, preferably hook and pile (i.e., VELCRO) is provided for attaching the top portion to the bottom portion via the two shoulder straps and the two side portions.

In use, the stiff stable surface of the bottom portion is positioned under the pad of a typical diaper-changing table with the four cloth-like portions extending therefrom. The infant is placed on the pad, and the top portion is then placed over the infant. The two shoulder straps and the two side portions of the top are fastened to the four cloth-like portions of the bottom to comfortably and safely secure the infant on the changing table.

A feature and advantage of the present invention is to provide a new and improved diaper changing apparatus that is more comfortable and natural feeling to an infant than previous restraints.

Another feature and advantage of the present invention is to provide a new and improved diaper changing apparatus having a four-point restraint system thereby more adequately securing an infant during a diaper change.

Another feature and advantage of the present invention is to provide a new and improved diaper changing apparatus having hook and pile fastener for more easily securing and removing an infant.

These and other objects, features and advantages of the invention will become more apparent to one skilled in the art from the following description and claims when read in light of the accompanying drawings.

DETAILED DESCRIPTION OF THE PREFERRED EMBODIMENT

Figure 1:
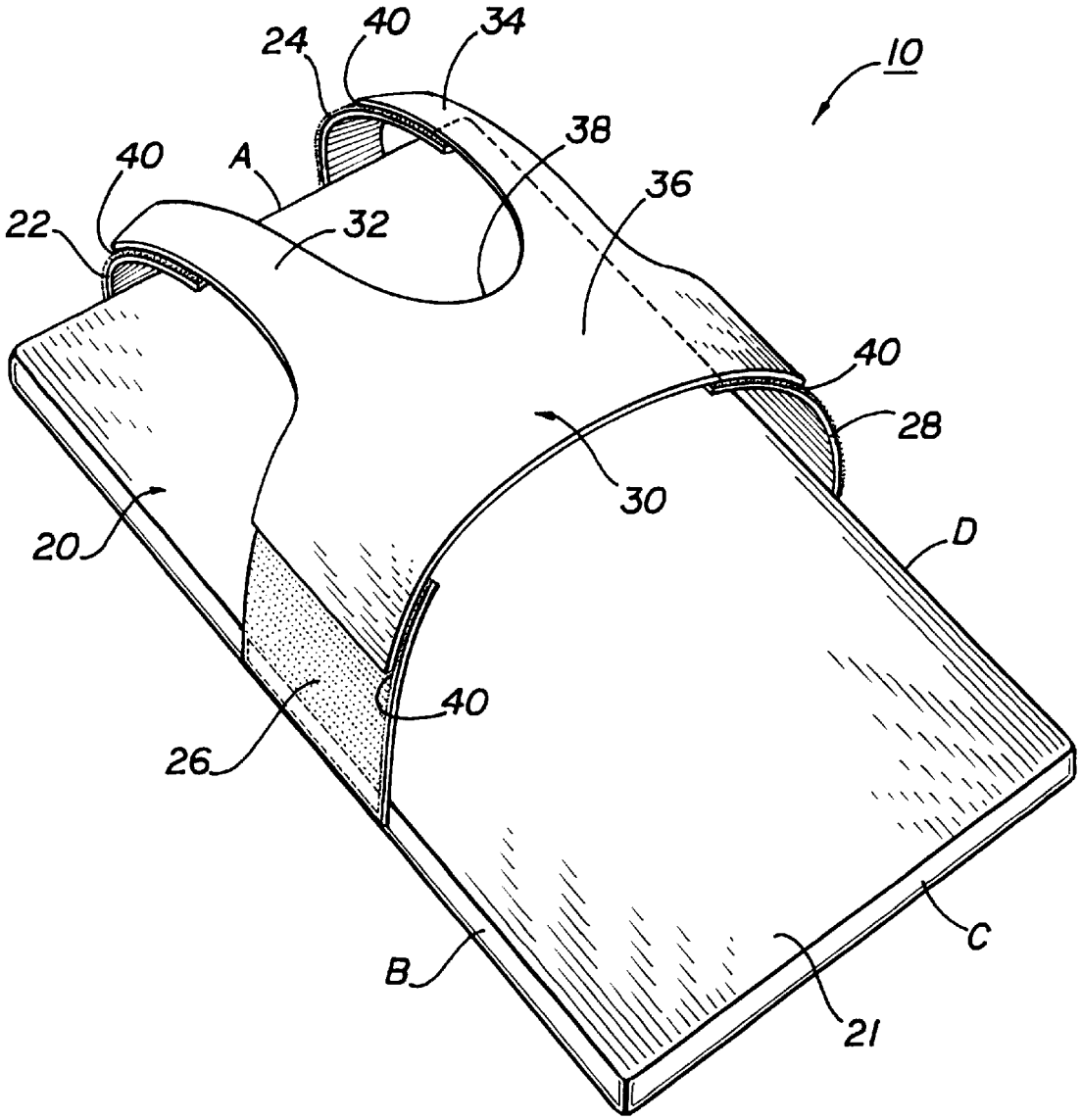
FIG. 1 is a perspective view of the present invention according to a preferred embodiment.

Referring now to FIG. 1, device 10 generally comprises a bottom portion 20, top portion 30 and fasteners 40.

More specifically, bottom portion 20 comprises rigid surface 21, first shoulder extension 22, second shoulder extension 24, first mid-body extension 26, and second midbody extension 28. Preferably, rigid surface 21 is generally rectangular shaped having edges A, B, C and D, and is dimensioned to fit common diaper changing tables found in public facilities and available for home use. First shoulder extension 22 and second shoulder extension 24 are attached to rigid surface 21 at edge A and are spaced a distance apart; the distance is sufficient enough to allow an infant's head to fit between the two shoulder extensions but small enough to rest on an infant's shoulders. First shoulder extension 22 and second shoulder extension 24 are made of flexible material, and therefore the distance between the two shoulder extensions does not need to be exact and can thus function for all infants of diaper age having various sized heads and shoulders.

Attached at edge B of rigid surface 21 is first mid-body extension 26. Attached at edge D of rigid surface 21 is second mid-body extension 28. First mid-body extension 26 and second mid-body extension 28 are spaced an equal distance from edge A and at approximately a distance wherein the two mid-body extensions are located near the stomach area of an infant. Both first mid-body extension 26 and second mid-body extension 28 are made from a flexible material so that device 10 can function for all infants of diaper age having various sized stomachs and torsos.

The top portion 30 is generally tank-top shaped having first shoulder strap 32, second shoulder strap 34 and mid-body portion 36. Top portion 30 is, preferably, one continuous piece made of flexible material. First shoulder strap 32 and second shoulder strap 34 are spaced apart and generally form a U-shaped opening 38 for fitting over and/or around an infant's head and shoulders. First shoulder strap 32 and second shoulder strap 34 align with first shoulder extension 22 and second shoulder extension 24 of bottom portion 20, respectively, when top portion 30 is placed over an infant. One side of mid-body portion 36 aligns with first mid-body extension 26 of bottom portion 20, and the other side of mid-body portion 36 aligns with second mid-body extension 28 of bottom portion 20. The aligned portions are removably fastened together by fasteners 40. Fasteners 40, preferably, are hook and pile type fasteners (i.e., VELCRO) that allow top portion 30 to be quickly and easily separated from bottom portion 20. However, a sufficient amount of fastening force is used to prevent an infant, on his own, from separating top portion 30 from bottom portion 20. Fasteners other than the hook and pile type can be used, such as snaps, buttons, ties and the like.

In use, rigid surface 21 is slid under the pad of a common diaper changing table with first shoulder extension 22, second shoulder extension 24, first mid-body extension 26 and second mid-body extension 28 extending therefrom. If the table or other surface does not have a pad, device 10 is positioned on top of the surface. With bottom portion 20 in position, the infant is placed on the pad (or on rigid surface 21, if no pad is available), and top portion 30 is placed over the infant with the infant's head extending through U-shaped opening 38. Top portion 30 is fastened to bottom portion 20 via fasteners 40, thereby safely and comfortably securing the infant on the table for his or her diaper to be changed.

To accommodate larger children and adults, it is apparent that the dimensions of device 10 may be enlarged accordingly. Furthermore, it is also apparent that a multitude of different types of material may be used for top portion 30 and the extensions of bottom portion 20. Preferably, the material is washable. For instance, cotton, nylon, polyester, plastic sheeting or other flexible material may be utilized. Rigid surface 21 can be made of any material which provides a stiff stable surface to which the shoulder and mid-body extensions can be secured, such as a stiff plastic sheet, stiff cardboard and the like. In an alternate embodiment, a pad (not shown) is attached to the top surface of rigid surface 21 so that device 10, if used on a table without a pad or a table in which rigid surface 21 can not be placed under the pad, will be more comfortable to the infant.

The above detailed description of a preferred embodiment or alternate embodiments are for example purposes only and are not meant to limit the scope or spirit of the invention as disclosed herein and as defined by the appended claims.

What is claimed is:

1. A diaper changing restraint system for restraining a person while changing the person's diaper, comprising:

a. a bottom portion including a stiff stable surface;

b. a top portion having an opening there through dimensioned for receiving a head of the person; and c. fastening means carried by a least one of said bottom portion and said top portion for fastening said top portion to said bottom portion, wherein the person is placed on said bottom portion, and said top portion is placed over the person and secured to said bottom portion by said fastening means, thereby securing the person to facilitate change of the person's diaper.

2. A diaper changing restraint system as in claim 1, wherein said bottom portion includes first and second shoulder extensions secured to said bottom portion for fitting over the shoulders of the person.

3. A diaper changing restraint system as in claim 2, wherein said top portion includes a first shoulder strap and a second shoulder strap which define said opening for receiving the head of the person and which are designed to be releasably secured to said first and second shoulder extensions, respectively.

4. A diaper changing restraint system as in claim 3, wherein said bottom portion further includes first and second mid-body extensions secured to said bottom portion for fitting over the mid-body of the person.

5. A diaper changing restraint system as in claim 4, wherein said top portion further includes first and second mid-body portions designed to be releasably secured to said first and second mid-body extensions, respectively.

6. A diaper changing restraint system as in claim 5, wherein said fastening means allows for said first and second shoulder straps to be releasably secured to said first and second shoulder extensions and said first and second mid-body portions to be releasably secured to said first and second mid-body extensions.

7. A diaper changing restraint system as in claim 6, wherein said fastening means is selected from the group consisting of hook and pile fasteners, buttons, snaps and ties.

8. A diaper changing restraint system as in claim 1, wherein said top portion comprises a flexible washable material.

9. A diaper changing restraint system as in claim 1, wherein said system provides a four-point restraint system for securing the person.

10. A diaper changing restraint system for restraining a person while changing the person's diaper, comprising:

a. a bottom portion including a stiff stable surface;

b. a top portion having an opening there through dimensioned for receiving a head of the person; and c. fasteners carried by a least one of said bottom portion and said top portion, wherein the person is placed on said bottom portion, and said top portion is placed over the torso of the person and secured to said bottom portion by said fasteners, thereby restraining the torso of the person while the waist area and legs of the person remain unrestrained to facilitate change of the person's diaper.

* * * * *